US012226664B2

(12) United States Patent
Jacobson

(10) Patent No.: US 12,226,664 B2
(45) Date of Patent: Feb. 18, 2025

(54) BARBELL SAFETY DEVICE AND METHODS

(71) Applicant: John T. Jacobson, Baraga, MI (US)

(72) Inventor: John T. Jacobson, Baraga, MI (US)

( * ) Notice: Subject to any disclaimer, the term of this patent is extended or adjusted under 35 U.S.C. 154(b) by 198 days.

(21) Appl. No.: 17/986,851

(22) Filed: Nov. 14, 2022

(65) Prior Publication Data

US 2023/0149766 A1 May 18, 2023

Related U.S. Application Data

(60) Provisional application No. 63/360,966, filed on Nov. 12, 2021.

(51) Int. Cl.
*A63B 21/078* (2006.01)
*A63B 21/072* (2006.01)

(52) U.S. Cl.
CPC ..... *A63B 21/0783* (2015.10); *A63B 21/0724* (2013.01)

(58) Field of Classification Search
CPC ..... A63B 21/0783; A63B 21/0724; A63B 21/4029; A63B 21/072; A63B 21/078; A63B 2023/0411; A63B 2210/50; A63B 2225/09
See application file for complete search history.

(56) References Cited

U.S. PATENT DOCUMENTS 2,470,815 A * 5/1949 Harvey ..... A63B 21/075 482/106
4,799,674 A * 1/1989 Ochab ..... A63B 21/078 482/104
4,890,831 A * 1/1990 Craig ..... A63B 21/0724 482/104
5,468,203 A * 11/1995 Okonkwo ..... A63B 21/078 482/4
11,833,386 B2 * 12/2023 Esco ..... A63B 21/0783
2006/0166794 A1 * 7/2006 Brown ..... A63B 21/078 482/104

* cited by examiner

*Primary Examiner* — Megan Anderson
(74) *Attorney, Agent, or Firm* — Device Patent LLC

(57) ABSTRACT

Disclosed herein is a barbell safety device. The device mounts in pairs over the spaced stop collars of a barbell. The device is generally 'T' shaped and is used in an inverted 'T' orientation. The device comprises a stop collar receiver configured to house a portion of a loadable sleeve of a barbell as well as the stop collar of the barbell. A central support assembly extends from the stop collar receiver to an elongate base support. The central support assembly in preferred forms is telescoping and can be fixed by pins or other means at a variety of lengths to accommodate to the needs of the user. When the barbell is lowered during exercise, the base support will engage the ground and prevent further lowering of the barbell thereby protecting the user from injury.

20 Claims, 5 Drawing Sheets

BARBELL SAFETY DEVICE AND METHODS

CROSS REFERENCE TO RELATED APPLICATIONS

This application claims priority to Provisional Patent Application No. 63/360,966 filed Nov. 12, 2021, the entire disclosure of which is hereby incorporated by reference and relied upon.

BACKGROUND OF THE INVENTION

Field of the Invention

The invention relates generally to weightlifting equipment, and more particularly to safety equipment used when using a standard or Olympic barbell to perform a bench press or squatting exercise.

As illustrated in the prior art FIGS. 1-5, bench press devices of the prior art include the weight bench configured to support a user's trunk in a supine position. The weight bench is typically joined a pair of uprights having saddle grips along or at a superior end of the uprights to securely hold a weight bar also known as a barbell. The uprights and/or saddle grips may be adjustable in height. Weightlifting enthusiasts tend to use an 'Olympic' barbell that has generally standard dimensions of 86 inches in length but are sometimes other lengths such as 60 inches. The center part of the barbell is typically partially knurled and has a diameter well suited for gipping with a user's hand such as 1.2 inches for example. On opposed ends of the Olympic weight bar are loadable sleeves having an outer diameter (generally 2 inches) suited to support one or more Olympic weight plates. At the medial end of the loadable sleeves are stop collars, typically about 3 inches in diameter and about 1.25 inches wide. When a user loads the weight plates on the loadable sleeves, the stop collars provide a hard stop for the weight plates to assure the weight plates are evenly balanced on each side of the weight bar. The loadable sleeves are fixed to the weight bar, but are preferably free to spin about the central axis of the weight bar in order to minimize any torsional forces that may occur during lifting. Once one or more weight plates are loaded on the loadable sleeves, the weight plates can be held in place by a lock collar which often is in the form of a spring clip as noted in FIG. 2.

There are obvious dangers in performing a bench press exercise. As noted in FIG. 3, the user is situated under the weight bar during the exercise and may become trapped underneath the weighted bar if they become too fatigued to control the weight bar and weights during the exercise. In this situation, the weight bar can become stuck across the user's neck or chest thereby limiting their ability to breath and/or restricting blood flow to their brain or other parts of their body. Musculo-skeletal injuries may also result.

The prior art has typically addressed this problem by suggesting that a spotter (FIG. 4) always be available to assist the user during the bench press exercise. This typically involves a spotter standing behind the user's head and assisting with additional control of the weight bar as needed. A spotter is not always available however, and often lifters are uncomfortable as to the positioning of the spotter near the lifter's head. These issues often lead to the risky behavior of the lifter using the bench press without a spotter. Another common way the prior art has addressed this safety issue is by integrating into the lifting bench a pair of stop arms 176 as illustrated in FIG. 5. In this case, upon fatigue of the lifter, the pair of stop arms 176 provide a resting surface 177 to place the weight bar in an emergency without crushing against the user's body. The rest surface 177 can often be adjusted a distance 'G' from the bench support surface 178 to accommodate to users having trunks of varying thickness.

There are however, tens if not hundreds of thousands of Olympic bench press weight benches throughout the world that are being used without the benefit of stop arms. Users of this equipment are at risk of injury. What is needed are devices that can be adapted to existing bar bell bench press configurations that provide safety to the user resulting from the loss of control of the barbell during exercise. What is needed are safety devices that can be used to start the bench press in the down position without touching or minimal pressure on the user's chest.

SUMMARY OF THE INVENTION

Disclosed herein are barbell safety devices that attach directly to the barbell for use during weightlifting exercises.

In one form, a barbell safety device couples with a barbell used on a weight bench.

In one form, the barbell safety device is used in pairs on a barbell.

In one form, the barbell safety device is used on a barbell that is resting on a weight bench.

In one form, the barbell safety device is generally 'T' shaped.

In one form, the barbell safety device is used in an 'inverted T' orientation when used in an operable configuration.

In one form, at the superior end of the barbell safety device is a stop collar receiver.

In one form, the stop collar receiver is at least partially cylindrical along a generally horizontal axis C.

In one form, the stop collar receiver comprises a retainer wall having an internal sleeve surface defining a sleeve cavity configured to house a loadable sleeve of a barbell.

In one form, the stop collar receiver comprises a retainer wall having an internal collar surface defining a stop collar cavity configured to house a stop collar of a barbell.

In one form, the stop collar cavity and sleeve cavity are in open communication.

In one form, the stop collar receiver comprises an outer surface.

In one form, the stop collar receiver comprises a stop surface positioned between the stop collar cavity and the sleeve cavity configured for abutting against the stop collar of a barbell.

In one form, a barbell safety device comprises a central support assembly.

In one form, the central support assembly comprises an upper support and a lower support.

In one form, the central support assembly is telescoping and fixable at a variety of lengths.

In one form, the stop collar receiver is fixed to the upper support by welds or other means known in the art.

In one form, the upper support is tubular and comprises an upper support wall with an internal upper support face defining an upper support cavity configured to receive a lower support therein in sliding relationship.

In one form, the upper support is tubular and houses the lower support in its inner cavity for telescoping adjustment along an axis B. In alternative embodiments, the upper support is housed within the lower support in its inner cavity for telescoping adjustment along an axis B.

In one form, the upper support comprises a joiner surface for fixation to outer surface of stop collar receiver.

In one form, the joiner surface is rounded.

In one form, the upper support comprises a plurality of upper lock holes operable to seat a lock pin therein.

In one form, lower support is tubular and comprises a lower support wall with a lower support outer face thereon.

In one form, the lower support comprises a plurality of lower lock holes operable to seat a lock pin therein.

In one form, the upper and lower lock holes are aligned such that a lock pin can be inserted to span the lock holes thereby fixing the central support assembly at a predetermined length.

In one form, a retainer member such as in the form of a chain or cable is utilized to hold the lock pin in position.

In one form, the telescoping feature of the barbell safety device utilizes alternative forms of locking such as friction style lever locking, a threaded rod such as used in a scissors jack, or a bayonet type locking wherein rotating one member 90 degrees, translating, and relocking is performed.

In one form, the lower support is fixedly coupled to a base support.

In one form, the base support comprises a base support wall.

In one form, the base support is in the form of a tube.

In one form, the base support comprises a floor face for facing the floor when in an operational configuration.

In one form, the base support comprises a superior face facing superiorly when in an operational configuration.

In one form, the lower support is fixed to the base support at a perpendicular angle.

In one form, one or more support gussets are positioned between the lower support and the base support for additional support and safety of the device.

In one form, the central support assembly is locked in a storage configuration whereby the supports are retracted within each other.

In one form, the central support assembly is locked in an extended configuration whereby it can be used as a safety device.

In one form, one or more end caps are utilized to close off open tube ends such as the base support.

In one form, a base ring is fixed between support gussets for additional support to the central support assembly.

In one form, an inferior ring surface of the base ring is fixed to superior face of base support.

In one form, a base ring cavity is configured to house a portion of the lower support therein.

In one form, a support plate is generally in the form of a square, rectangle, or circle comprises a central support plate cavity extending therethrough.

In one form, the support plate is fixed to the superior ring surface of the base ring.

In one form, the lower support is fixed within the central support plate cavity and the base ring cavity.

In one form, the base support includes foot pods extending from floor face.

In one form, a method for using a barbell safety device such as those devices described herein comprise a variety of steps as illustrated in FIG. 8.

BRIEF DESCRIPTION OF THE SEVERAL VIEWS OF THE DRAWINGS

These and other features and advantages of the present invention will become more readily appreciated when considered in connection with the following detailed description and appended drawings, wherein each drawing is according to one or more embodiments shown and described herein, and wherein.

DETAILED DESCRIPTION OF SELECTED EMBODIMENTS OF THE INVENTION

Select embodiments of the invention will now be described with reference to the Figures. Like numerals indicate like or corresponding elements throughout the several views and wherein various embodiments are separated by letters (i.e. 100, 100B, 100C). The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

Disclosed herein are barbell safety devices that attach directly to the barbell for use during weight lifting exercises such as bench press exercises and squatting exercises.

Figure 6:
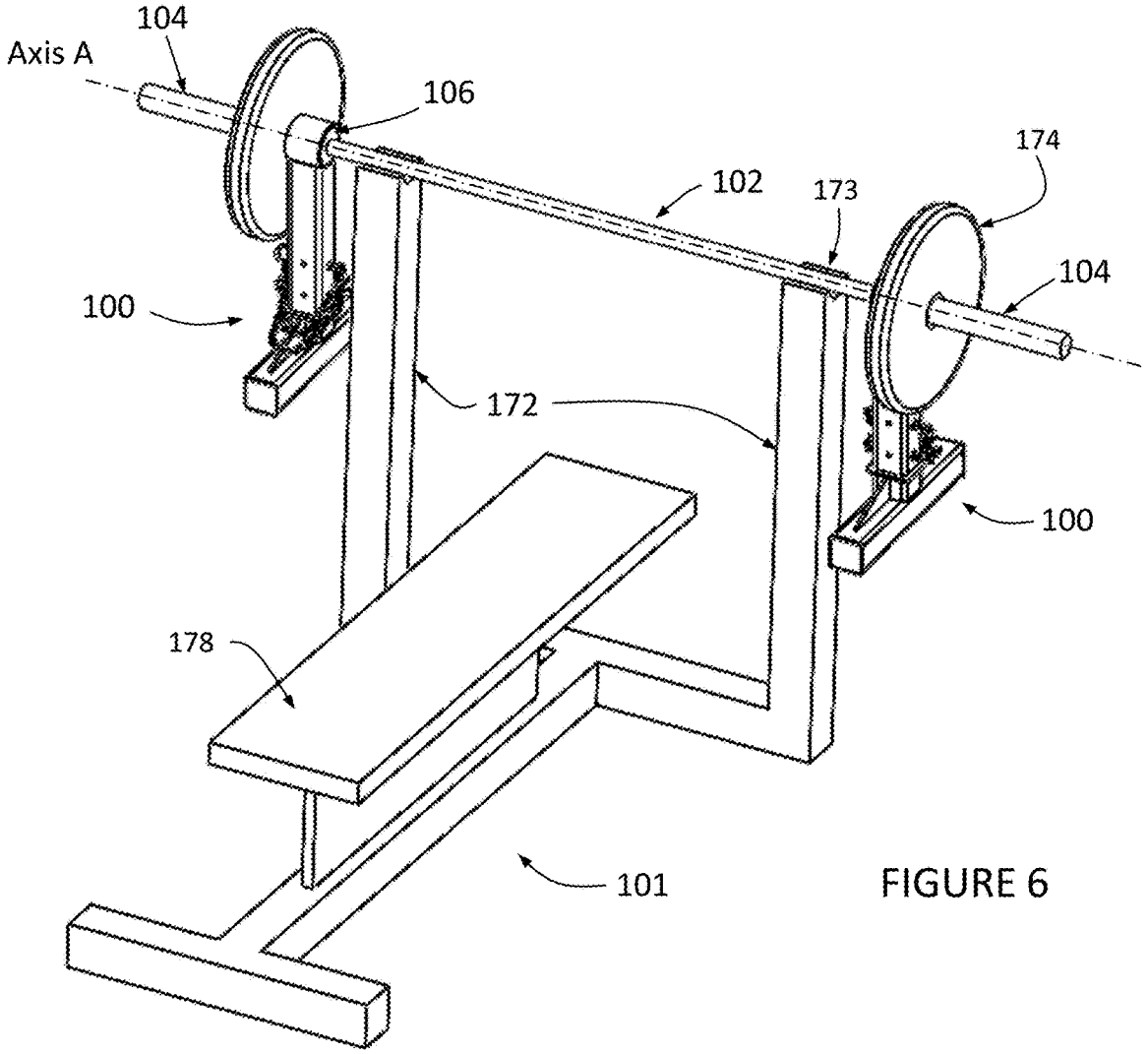
FIG. 6 depicts a perspective view of a weight bench and Olympic barbell with an embodiment of the barbell safety device mounted thereon.
Figure 6A:
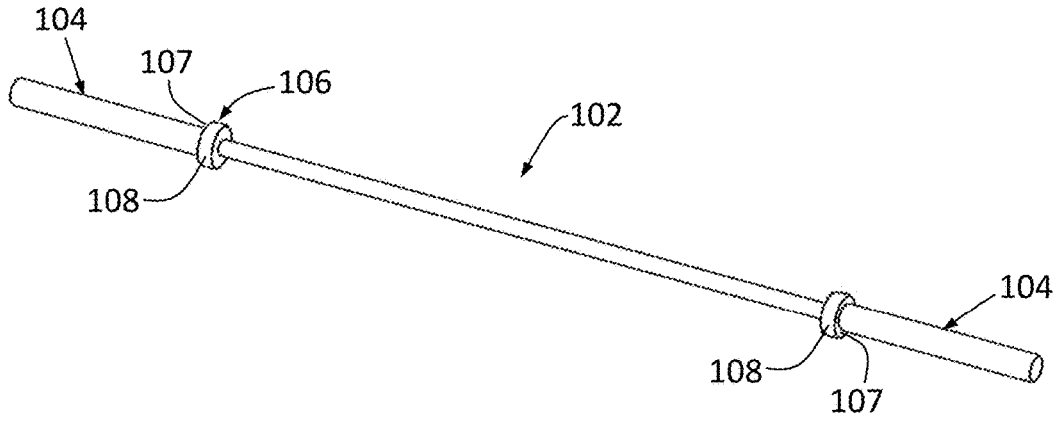
FIG. 6A depicts a perspective view of a common barbell.

As depicted in FIG. 6, a barbell safety device 100 is illustrated as coupled with a barbell 102 as would be used on a weight bench 101. The barbell safety device is used in pairs on a barbell 102 and therefore can be described as a first barbell safety device and a second barbell safety device. The barbell safety device is coupled to a barbell 102 that is resting on a weight bench 101. As noted in more detail later, each stop collar on the barbell is housed within cavities within the stop collar receiver of the barbell safety device.

Figure 1:
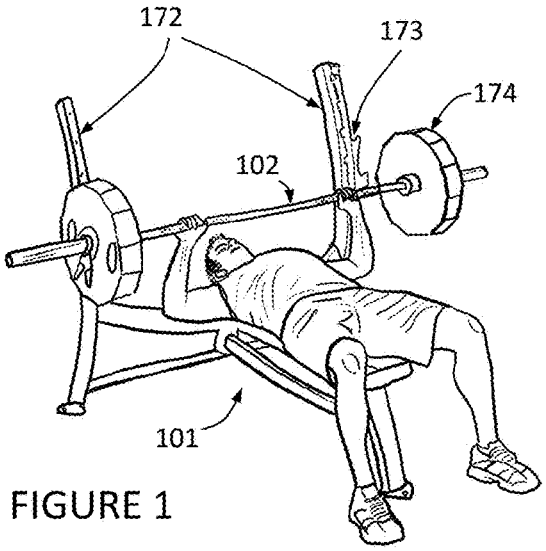
FIG. 1 depicts a perspective view of a user performing a bench press exercise as noted in the prior art.
Figure 2:
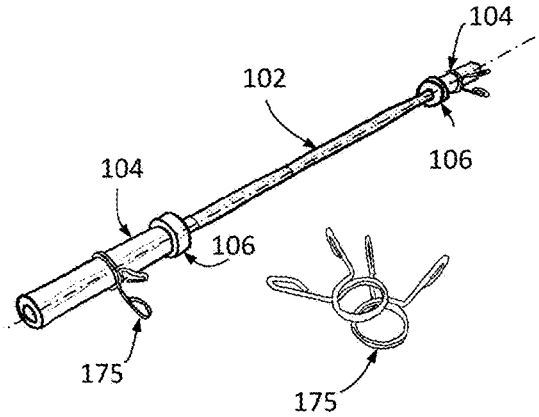
FIG. 2 depicts a perspective view of one type of Olympic barbell as noted in the prior art.
Figure 3:
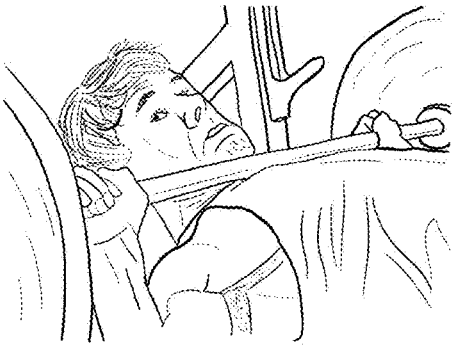
FIG. 3 depicts a perspective view of a user being injured by a barbell as noted in the prior art.
Figure 4:
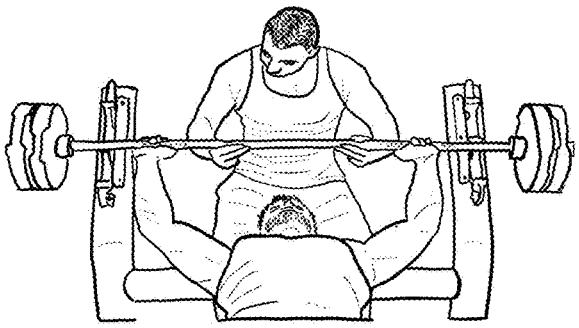
FIG. 4 depicts a front view of a spotter assisting an individual on a bench press as noted in the prior art.
Figure 5:
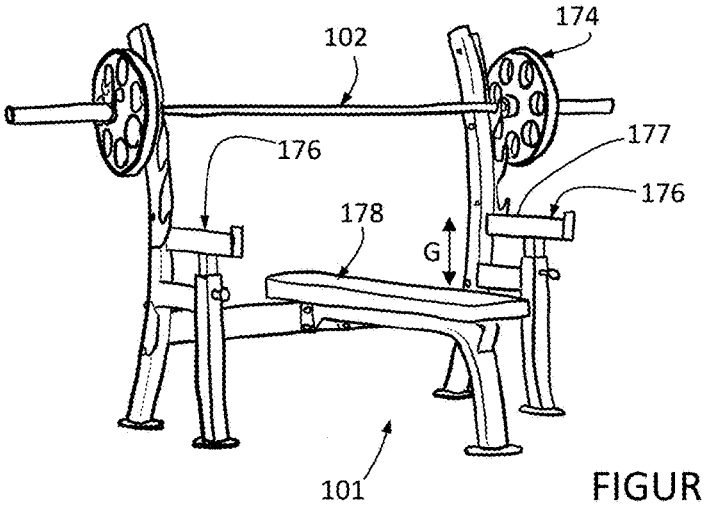
FIG. 5 depicts a perspective view of a weight bench with integrated stop arms as noted from the prior art.
Figure 7:
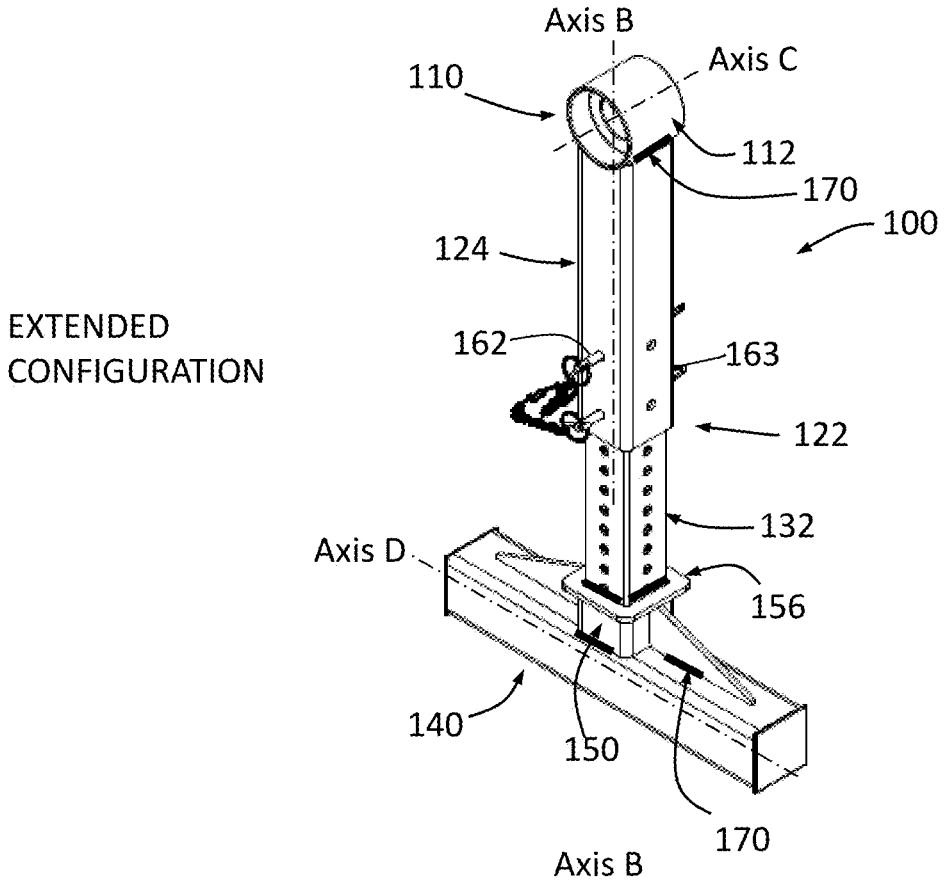
FIG. 7 depicts a perspective view of an embodiment of the barbell safety device in an extended configuration.
Figure 8:
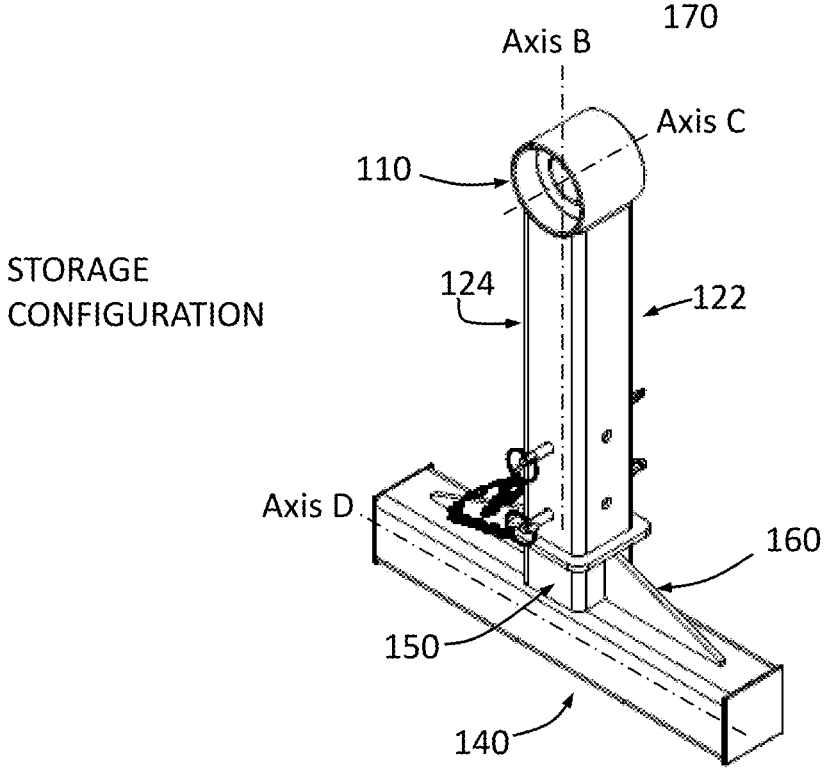
FIG. 8 depicts a perspective view of an embodiment of the barbell safety device in a storage configuration.
Figure 9A:
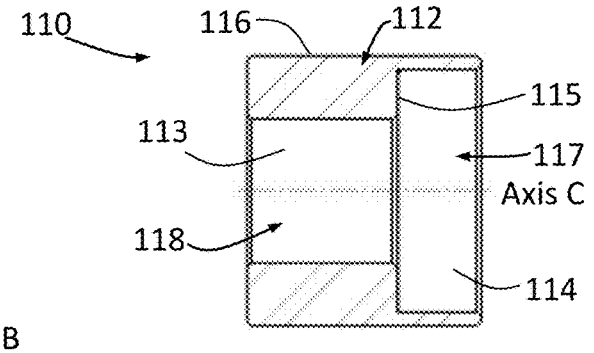
FIG. 9A depicts a central cross-sectional view of the stop collar receiver of FIG. 9.
Figure 9B:
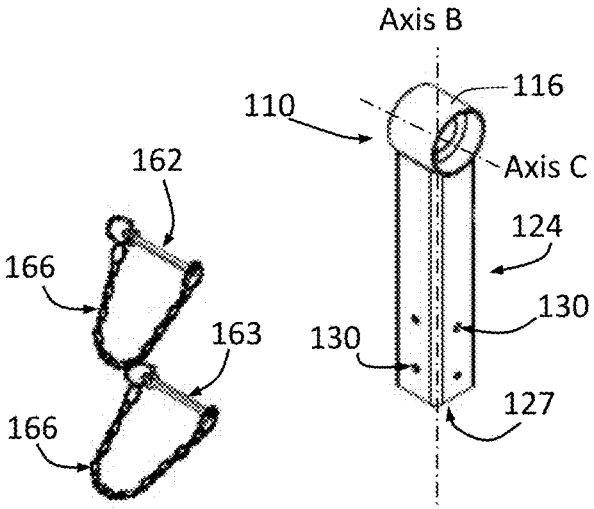
FIG. 9B depicts a perspective view of the upper support of FIG. 9.
Figure 9B:
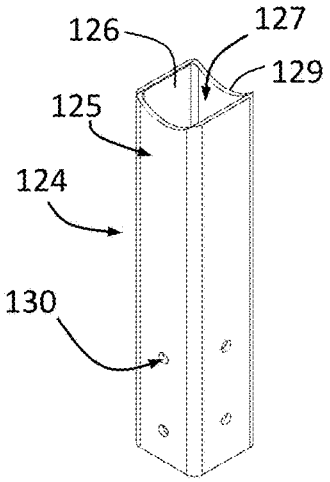
Figure 9:
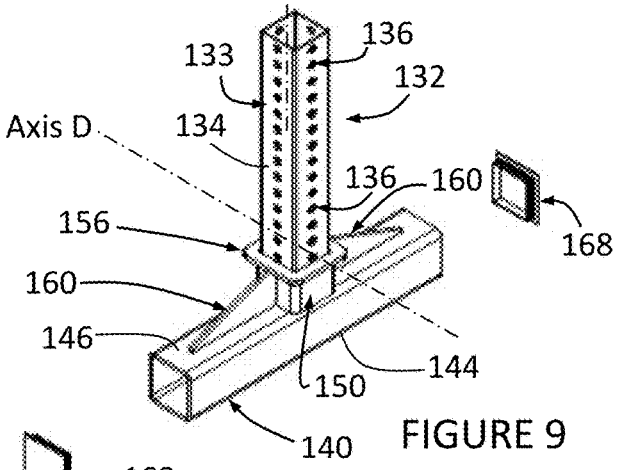
FIG. 9 depicts a partially exploded perspective view of an embodiment of the barbell safety device.
Figure 9C:
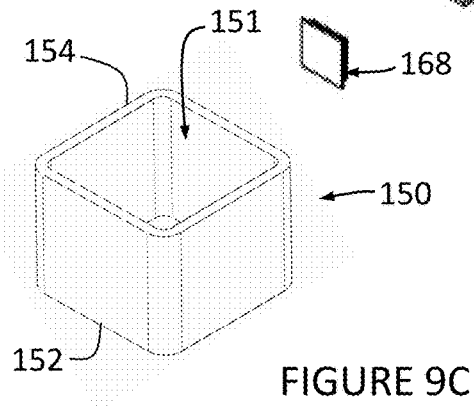
FIG. 9C depicts a perspective view of the base ring of FIG. 9.
Figure 9D:
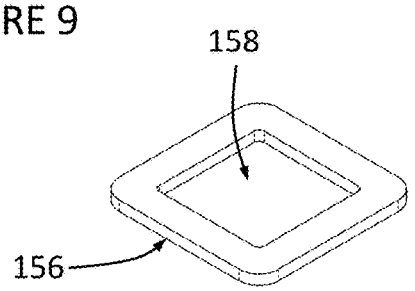
FIG. 9D depicts a perspective view of the support plate of FIG. 9.

As noted in FIGS. 7-9, the barbell safety device 100 is generally 'T' shaped and is used in an 'inverted T' orientation when used in an operable configuration. Located at the superior end of the barbell safety device 100 is a stop collar receiver 110. The stop collar receiver in most embodiments is at least partially cylindrical internally along a generally horizontal axis C. The stop collar receiver can assume other profiles beside cylindrical externally. As noted in FIG. 9A, the stop collar receiver 110 comprises a retainer wall 112 having a sleeve surface 113 defining an internal sleeve cavity 118 configured to house a portion of a loadable sleeve 104 (see FIG. 2) of a barbell. In this embodiment, the sleeve cavity is generally cylindrical. The stop collar receiver's 110 retainer wall 112 also comprises a collar surface 114 defining an internal stop collar cavity 117 configured to house a stop collar 106 (see FIG. 26A) of a barbell. Stop collar 106 has lateral face 107 facing lateral, and a radial face 108 facing outward from axis A of barbell 102. As noted in FIG. 9A, the stop collar cavity 117 and sleeve cavity 118 are in open communication. The stop collar receiver 110 also comprises an outer surface 116 which in this embodiment is rounded.

The stop collar receiver 110 also comprises a vertically orientated stop surface 115 positioned between the stop collar cavity 117 and the sleeve cavity 118 and is configured for abutting against the stop collar (see FIG. 2) of a barbell to assure proper positioning.

Further to the Figures, barbell safety device 100 comprises a central support assembly 122. In this embodiment, the central support assembly comprises an upper support 124 and a lower support 132 and telescoping and fixable at a variety of lengths. This adjustment provides variation for distance 'G' discussed earlier to compensate for user's having varying trunk thicknesses and limiting how low the barbell can go with respect to the bench in a bench press exercise. In this embodiment the barbell safety device is manufactured substantially of metal and with components welded together where fixation is required. Here, stop collar receiver 110 is fixed to the upper support 124 by welds or other means known in the art between joiner surface 129 and outer surface 116. The upper support 124 as illustrated is tubular (I.e. round, square, rectangular) and comprises an upper support wall 125 with an internal upper support face 126 defining an upper support cavity 127 configured to receive a lower support 132 therein. The applicant recognizes that this telescoping arrangement between the upper and lower support could be reversed, but here the upper support 124 is tubular and houses the lower support 132 in its inner cavity for telescoping adjustment along an axis B. In alternative embodiments, the upper support is housed within the lower support in its inner cavity for telescoping adjustment along an axis B. Upper support 124 further comprises a joiner surface 129 for fixation to outer surface 116 of stop collar receiver 110. In this embodiment, the joiner surface is rounded. In addition, the upper support 124 comprises a plurality of upper lock holes 130 extending generally perpendicular to axis B and operable to seat a lock pin therein.

The lower support 132 in this embodiment is also tubular and comprises a lower support wall 133 with a lower support outer face 134 thereon. The lower support 132 comprises a plurality of lower lock holes 136 operable to seat a lock pin therein. The upper and lower lock holes are aligned such that a lock pin can be inserted to span the lock holes on both supports thereby fixing the central support assembly at desired lengths. A retainer member 166 such as in the form of a chain and/or cable and/or clip is utilized to hold the lock pin in position. In alternative embodiments, telescoping is achieved by supports that may not have a common central axis such as coupled by tongue and groove.

The lower support 132 is fixedly coupled to a base support 140. Here, the base support 140 comprises a base support wall 141 and is in the form of a tube which in this embodiment is generally square. Again, other profiles can be used such as round, rectangular, and even plate forms. The base support 140 comprises a floor face 144 for facing the floor when in an operational configuration. Extending from the floor face can be one or more levelers or pads such as felt or polymer pads. The base support 140 also comprises a superior face 146 facing superiorly when in an operational configuration. As depicted here, the lower support is fixed to the base support at a perpendicular angle using welds or fasteners or other means known in the art.

One or more support gussets 160 can be positioned between the lower support 124 and the base support 140 for additional support and safety of the device given the substantial forces imparted on the system.

FIG. 8 depicts the central support assembly 122 locked in a storage configuration whereby the supports are retracted within each other. FIG. 7, depicts the central support assembly locked in an extended configuration whereby it can be used as a safety device during lifting activities such as bench press and in some cases squatting exercises.

As noted, one or more end caps 168 can be utilized to close off open tube ends such as noted on base support 140. A base ring 150 can be fixed between support gussets 160 for additional support to the central support assembly 122. In addition, an inferior ring surface 152 of the base ring 150 is fixed to superior face 146 of base support 140. A base ring cavity 151 within the base ring is configured to house a portion of the lower support 132 therein. Welds 170 can be used for fixation at multiple locations. Some of these are depicted in the drawings.

A support plate 156, generally in the form of a square, rectangle, or circle comprises a central support plate cavity 158 extending therethrough. Here, the support plate 156 is fixed to the superior ring surface 154 of the base ring 150. The lower support 132 is fixed within the central support plate cavity 158 and the base ring cavity 151 by the use of welds in this embodiment. The base support 140 includes foot pods 145 extending from floor face 144.

In some embodiments, the lock collar 175 and loadable sleeve 104 of a barbell 102 rotate freely during use and are self-biased towards the floor by gravity.

Figure 10:
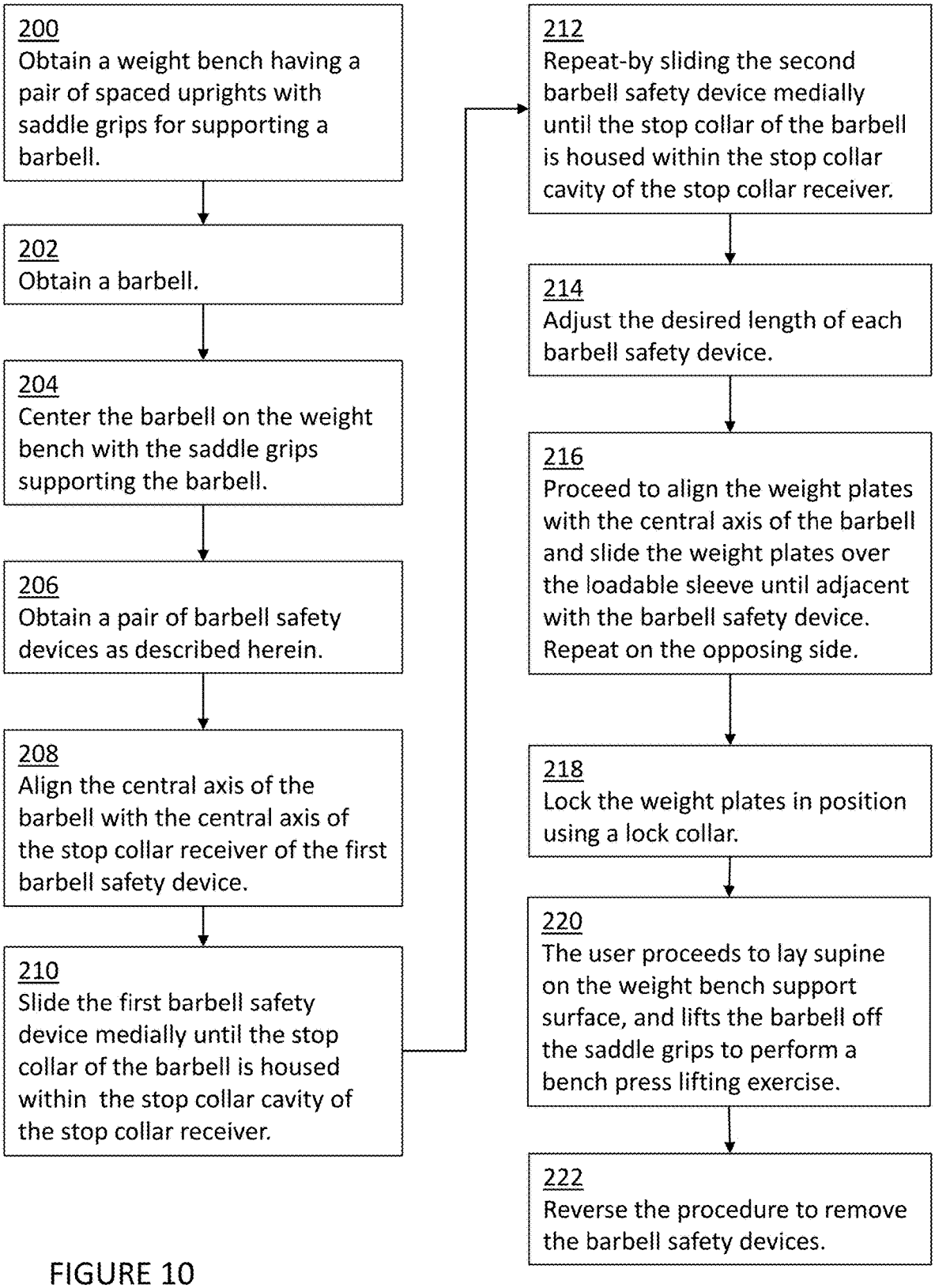
FIG. 10 depicts one embodiment of a flow diagram of a method of using a barbell safety device as disclosed herein.

In one embodiment, a method for using a barbell safety device such as those described herein comprise a variety of steps as illustrated in FIG. 10. Obtain a weight bench 101 having a pair of spaced uprights 172 with saddle grips 173 for supporting a barbell (200). Obtain a barbell (202). Center the barbell on the weight bench 101 with the saddle grips 173 supporting the barbell (204). Obtain a pair of barbell safety devices as described herein (206). Align the central axis of the barbell with the central axis of the stop collar receiver of the first barbell safety device (208). Orientate the stop collar cavity medially. Slide the first barbell safety device medially until the stop collar 106 of the barbell is housed within the stop collar cavity of the stop collar receiver (210). Repeat the previous step by sliding the second barbell safety device medially on the opposing side of the barbell until the stop collar 106 of the barbell is housed within the stop collar cavity of the stop collar receiver (212). Adjust the desired length of each barbell safety device (214) by removing the first lock pin 162 and second lock pins 163, adjusting to the desired telescoping length, then repinning at the new length (two pins are provided for safety, but only one is required). Proceed to align the weight plates 174 with the central axis of the barbell and slide the weight plates 174 over the loadable sleeve 104 until it is adjacent with the barbell safety device, then repeat on the other side (216). Lock the weight plates 174 in position using a lock collar 175 (218). The user then lays supine on the weight bench support surface 178 and lifts the barbell off the saddle grips 173 to safely perform a bench press lifting exercise (220). When the floor face 144 abuts the floor, the barbell will maintain a safe distance from the bench support surface 178.

It is noted that the terms "substantially" and "about" and "generally" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

The foregoing invention has been described in accordance with the relevant legal standards, thus the description is exemplary rather than limiting in nature. Variations and modifications to the disclosed embodiment may become apparent to those skilled in the art and fall within the scope of the invention.

The invention claimed is:

1. A method of using a barbell safety device comprising the following steps:

obtaining a weight bench wherein said weight bench comprises a bench support surface for supporting a trunk of a user, a pair of spaced uprights, and a pair of spaced saddle grips extending from said pair of spaced uprights operable to support a barbell elevated above said bench support surface;

obtaining a barbell wherein said barbell comprises a loadable sleeve at each end of said barbell operable to support a weight plate, and a stop collar medial to each of the loadable sleeves;

centering the barbell on the pair of spaced saddle grips of the weight bench;

obtaining a pair of barbell safety devices wherein the pair of barbell safety devices comprise a first barbell safety device and a second barbell safety device and each of the pair of barbell safety devices comprise a stop collar receiver having a retainer wall wherein said retainer wall comprises an internal collar surface defining a stop collar cavity and an internal sleeve surface defining a sleeve cavity, an upper support extending from an outer surface of said stop collar receiver with a lower support axially adjustable with respect to said upper support, and a base support coupled perpendicularly to an inferior end of said lower support;

aligning a central axis of the barbell with the central axis of the stop collar receiver of the first barbell safety device of said pair of barbell safety devices; and sliding the first barbell safety device medially until one of the stop collars of the barbell is housed within the stop collar cavity of the stop collar receiver.

2. The method of using the barbell safety device of claim 1 further comprising the step of:

the user laying supine on the bench support surface of said weight bench; and lifting the barbell and the barbell safety devices off said pair of saddle grips to perform a bench press lifting exercise.

3. The method of using the barbell safety device of claim 2 further comprising the step of:

including base supports when obtaining said pair of barbell safety devices; and, lowering the barbell towards the user's chest until the base supports of the pair of barbell safety devices engage the floor thereby supporting the barbell above the user's body.

4. The method of using the barbell safety device of claim 1 further comprising the steps of:

aligning a central axis of the barbell with the central axis of the stop collar receiver of the second barbell safety device; and sliding the second barbell safety device medially until the stop collar of the barbell is housed within the stop collar cavity of the opposing stop collar receiver.

5. The method of using the barbell safety device of claim 1 further comprising the step of:

adjusting a desired length of at least one of said first barbell safety device and said second barbell safety device.

6. The method of using the barbell safety device of claim 1 further comprising the step of:

aligning a weight plate with the central axis of said barbell; and sliding said weight plate medially over one of said loadable sleeves until said weight plate is adjacent to the respective barbell safety device.

7. The method of using the barbell safety device of claim 1 further comprising the step of:

locking said weight plate in position on said loadable sleeve using a lock collar.

8. The method of using the barbell safety device of claim 1 further comprising the steps of:

positioning the barbell and the pair of barbell safety devices back on said pair of saddle grips; and removing the lock collars and weight plates from the barbell.

9. The method of using the barbell safety device of claim 1 further comprising the step of:

sliding the pair of barbell safety devices laterally along the central axis of the barbell to remove them from the barbell.

10. A barbell safety device comprising:

a stop collar receiver operable for housing a stop collar of a barbell;

said stop collar receiver comprising a retaining wall encircling a central axis of said stop collar;

said retaining wall comprising a sleeve surface;

said retaining wall comprising a collar surface;

said sleeve surface defining a sleeve cavity extending from one end of said stop collar receiver;

said collar surface defining a stop collar cavity extending from an opposing end of said stop collar receiver;

said sleeve cavity operable to house a portion of a loadable sleeve of said barbell;

said stop collar cavity operable to house at least a portion of the stop collar of said barbell;

an upper support;

said upper support extending from said stop collar receiver;

said upper support comprising an upper support cavity along it's central axis;

a lower support;

said lower support at least partially housed in said upper support cavity;

a base support;

wherein said base support is fixed perpendicular at one end of said lower support.

11. The barbell safety device of claim 10 further comprising:

a stop surface;

said stop surface extending between said sleeve surface and said collar surface of said stop collar receiver and operable to abut a stop collar on a barbell in an operable configuration.

12. The barbell safety device of claim 10 further comprising:

at least one support gusset fixed between said lower support and said base support.

13. The barbell safety device of claim 10 further comprising:

a lower support outer face;

a plurality of lower lock holes extending through said lower support outer face for housing one or more lock pins.

14. The barbell safety device of claim 10 further comprising:

a lock pin operable for locking said upper support relative to said lower support along a central axis for adjusting the length of said barbell safety device.

15. The barbell safety device of claim 10 further comprising:

a support plate operable to limit overlap of said upper support with said lower support.

16. The barbell safety device of claim 10 further comprising:

lower lock holes;

said lower lock holes extending through said lower support;

upper lock holes;

said upper lock holes extending through said upper support; and whereas said upper lock holes and said lower lock holes are aligned at various telescoping positions of said upper support and said lower support.

17. The barbell safety device of claim 10 further comprising:

an outer surface on said stop collar receiver;

wherein said outer surface is cylindrical.

18. The barbell safety device of claim 10 whereby said barbell safety device is slidable over a said loadable sleeve of a barbell.

19. The barbell safety device of claim 10 further comprising:

upper lock holes;

lower lock holes;

a retainer member for securing a lock pin in said upper lock holes and said lower lock holes.

20. The barbell safety device of claim 10 further comprising:

a base ring;

whereby said base ring encircles said lower support to provide additional support between said lower support and said base support.

* * * * *